United States Patent [19]

Aué

[11] Patent Number: 4,931,060

[45] Date of Patent: Jun. 5, 1990

[54] DEVICE FOR THE INJECTION OF POSTS INTO EAR LOBES

[75] Inventor: Alfred A. Aué, Nuremberg, Fed. Rep. of Germany

[73] Assignee: Wittman GmbH, Fed. Rep. of Germany

[21] Appl. No.: 182,240

[22] Filed: Apr. 15, 1988

[30] Foreign Application Priority Data

May 30, 1987 [DE] Fed. Rep. of Germany ..... 3718256
Feb. 10, 1988 [EP] European Pat. Off. ..... 88101917.8

[51] Int. Cl.[5] ..... A61B 17/34
[52] U.S. Cl. ..... 606/188
[58] Field of Search ..... 128/329 R, 330; 124/27, 124/37; 606/188

[56] References Cited

U.S. PATENT DOCUMENTS 3,941,134 3/1976 McDonald ..... 128/330
4,009,718 3/1977 Hastings ..... 128/330
4,020,848 5/1977 DiCicco ..... 128/330
4,030,507 6/1977 Mann ..... 128/330
4,079,740 3/1978 Phalon ..... 128/330
4,527,563 7/1985 Reil ..... 128/329 R

*Primary Examiner*—Michael H. Thaler
*Assistant Examiner*—William Lewis
*Attorney, Agent, or Firm*—Browdy & Neimark

[57] ABSTRACT

A device for the injection of posts into ear lobes including a barrel with a grip, a bolt disposed in the barrel which can be cocked against a spring which is releasable by means of a release lever. Retaining devices are included on which may be provided, in front of the barrel and, a post and, at a distance from it and aligned with it, a locking element. For achieving an embodiment which is easy to operate and satisfies high sanitary requirements, the retaining devices have fastening devices for the releasable fastening of retaining elements which support the post and the locking element.

16 Claims, 2 Drawing Sheets a)
b)
c)

DEVICE FOR THE INJECTION OF POSTS INTO EAR LOBES

BACKGROUND OF THE INVENTION

1. Field of the Invention

The invention relates to a device for the injection of posts into ear lobes comprising a barrel with a grip, with a bolt being disposed in the barrel, which can be cocked against a spring which is releasable by means of a release lever. Retaining devices are provided in front of the barrel end which may be provided with a post. At a distance from the post and aligned with it, a locking element is provided. The retaining devices have fastening devices for the releasable fastening of retaining elements which support the post or the locking element.

2. The Prior Art

Such a device is known from, for example, U.S. Pat. No. 4,020,848. In this, as well as in other conventionally used devices, the retaining devices for the post and the locking element are integral parts of the injection device. Even though the post and the locking element are already partially in sterile packages, intense manipulation by hand is required when these parts are removed from the packaging and are inserted into the retaining devices in the injection device. This results in the possibility of the transfer of bacteria to the post and the locking element which then, of course, directly enter the open wound of the hole in the ear lobe and which results quite often in inflammation, sometimes even in grave illness.

An even greater danger is posed by the fact that the retaining elements are in direct contact with the ear lobe into which injection is to be made, so that they come in direct contact with the blood which may flow out during injection. This, too, is undesirable from a bacteriological point of view because of the possibility of infection by hepatitis-causing agents and the like. Above all, however, this entails a considerable risk factor in view of the latest knowledge regarding the transmission of the immune deficiency illness AIDS, since the known groups at risk are to a large extent also the groups for which use of the devices under discussion is intended.

It is known from U.S. Pat. No. 4,030,507 to provide the post and the locking element in separate retaining devices which are each taken separately from the packaging and inserted into the injection device. This carries quite a considerable danger that the sections of these parts which are turned towards the ear lobe are touched by the fingers. Furthermore, the retaining elements used herein can be used several times so that, if not handled correctly, posts can be inserted without prior sterile storage and handling. Finally, for performing the injection movement in the previously known devices the member of the device which holds the post parts must be brought against the ear lobe and then another part, which can be moved relative to the post part, must be moved by hand linearly in relation to the post part in order to press the post into the ear lobe. Exact and proper aim cannot be taken in this manner and such a procedure is considered unpleasant by both the operator and by the person who is to receive the post.

SUMMARY OF THE INVENTION

Based on the foregoing it is an object of the invention to design a device of the previously mentioned type in such a way that with a simple and unproblematic operation it is also possible to achieve a design which satisfies strict sanitary demands and also allows an exact, pain-free injection. This object is attained by the invention in that the locking element and the post are each disposed on retaining elements which can be plugged into each other and which are movable with respect to each other, so that the surfaces of the locking element and the post oriented towards the ear lobe have a sufficiently small outward distance from each other, when taken out of the packaging and positioned in the device, so that it becomes impossible to touch these surfaces, and in that the retaining elements after insertion in the device can be adjusted to a selectable distance conforming to the thickness of the respective ear lobe.

This design makes it possible to develop the insertable retaining elements as disposable parts so that it is assured with certainty that the parts which come into contact with the ear lobe to be pierced can only be used once. In this way, even when the device is used by personnel not medically trained, as for example in jeweler's stores, absolutely sanitary conditions are assured without the need for special precautionary steps. The retaining elements under consideration can be in the form of the packaging already required for the posts and the locking element so that accordingly it becomes possible to take them out of the packaging without even the least need the person handling them to touch them. Besides the obvious bacteriological advantages, the laborious placement of these parts in the known retaining devices is avoided.

In particular according to the present invention, the surfaces of the post part or the locking element oriented towards the ear lobe are not touched during insertion of these sterile packaged parts, because they are positioned at a close distance to each other. Only after they have teen inserted into the device are the retaining elements pulled apart and the distance between the locking element and the post is adjusted to the thickness of the ear lobe to be pierced.

It is advantageously provided that the distance of the one retaining element with respect to the other retaining element can be adjusted by means of a grip element in the form of a trigger biased by a spring.

It is advantageously provided that for the purpose of cocking, one grip element and one barrel element are placed adjustably with respect to the grip and the barrel. Because of this, the grip having a relatively large surface is available for cocking, so that the cocking operation can also be performed easily by women.

The longitudinally movable barrel element makes it possible to dispose the mounting device for the retaining element for the locking element on the barrel element. Because of this, there is a relatively large, mutual distance for inserting the retaining elements available, which allows unhampered and easy handling.

In an advantageous manner, the retaining element for the post may have a lateral groove for axially fixing in the longitudinal direction of the barrel, which engages a corresponding undercut at the barrel end.

It is furthermore advantageously provided that the retaining element for the post has resilient retaining legs resting against it such that the legs secure the post during storage, transport, and positioning. However, these legs are deformed beyond their limits of elasticity and break off when the post is pushed out. By means of this, it is assured that the post takes up an exactly defined position for injection but, in spite of this, is easily and exactly freed from the retaining element. On the other hand, by means of this structure, incorrect repeated use of the retaining elements, which does not satisfy sanitary requirements, is stopped.

In a particularly advantageous manner, the retaining elements for the post and/or the locking element are made of plastic, in particular cellulose acetate. Accordingly, these parts can be manufactured as cost-efficient, disposable items. By the use of transparent material, exact positioning before injection is additionally made possible.

In accordance with a further characteristic of the invention, the front end of the bolt can be rubber-like. This rubber-like front element engages the retaining element for the post and pushes it out correctly.

The bolt can have a first annular shoulder for the engagement of a spring-loaded cocking bolt connected with the movable grip or barrel element.

Furthermore, the bolt can have a second annular shoulder for the engagement of a locking bolt on the grip side. When the grip or barrel element is pushed back, the cocking bolt takes the bolt along when it moves and the locking bolt engages in the end position. In this position, the bolt is doubly secured because the locking bolt as well as the cocking bolt engage it.

Advantageously, a trigger is disposed on the grip or barrel which can be actuated in a direction vertically to the longitudinal direction of the barrel. This makes it possible to grasp the device with one hand by the grip and to operate the trigger with the other hand such that slipping because of or during triggering is avoided. In this way a very high degree of precision is attainable.

Advantageously a trigger is disposed on both sides of the device. In this way it can be operated with equal ease by left-handed and right-handed persons.

The trigger can act on a pivot lever which takes along the locking bolt and the cocking bolt when it moves so that both are simultaneously brought in a position of disengagement and the actual firing bolt is freed.

BRIEF DESCRIPTION OF THE DRAWINGS

Further characteristics, advantages and details of the invention ensue from the subsequent description of a preferred embodiment by means of the drawings, in which:

FIGS. 5*a, b, c* are a front view, a side view and a top view of the retaining element for the post; and FIGS. 6*a, b, c* are a side view, a front view and a top view, respectively, of the retaining element for the locking element.

DETAILED DESCRIPTION OF A PREFERRED EMBODIMENT

Figures 1, 5, 6:
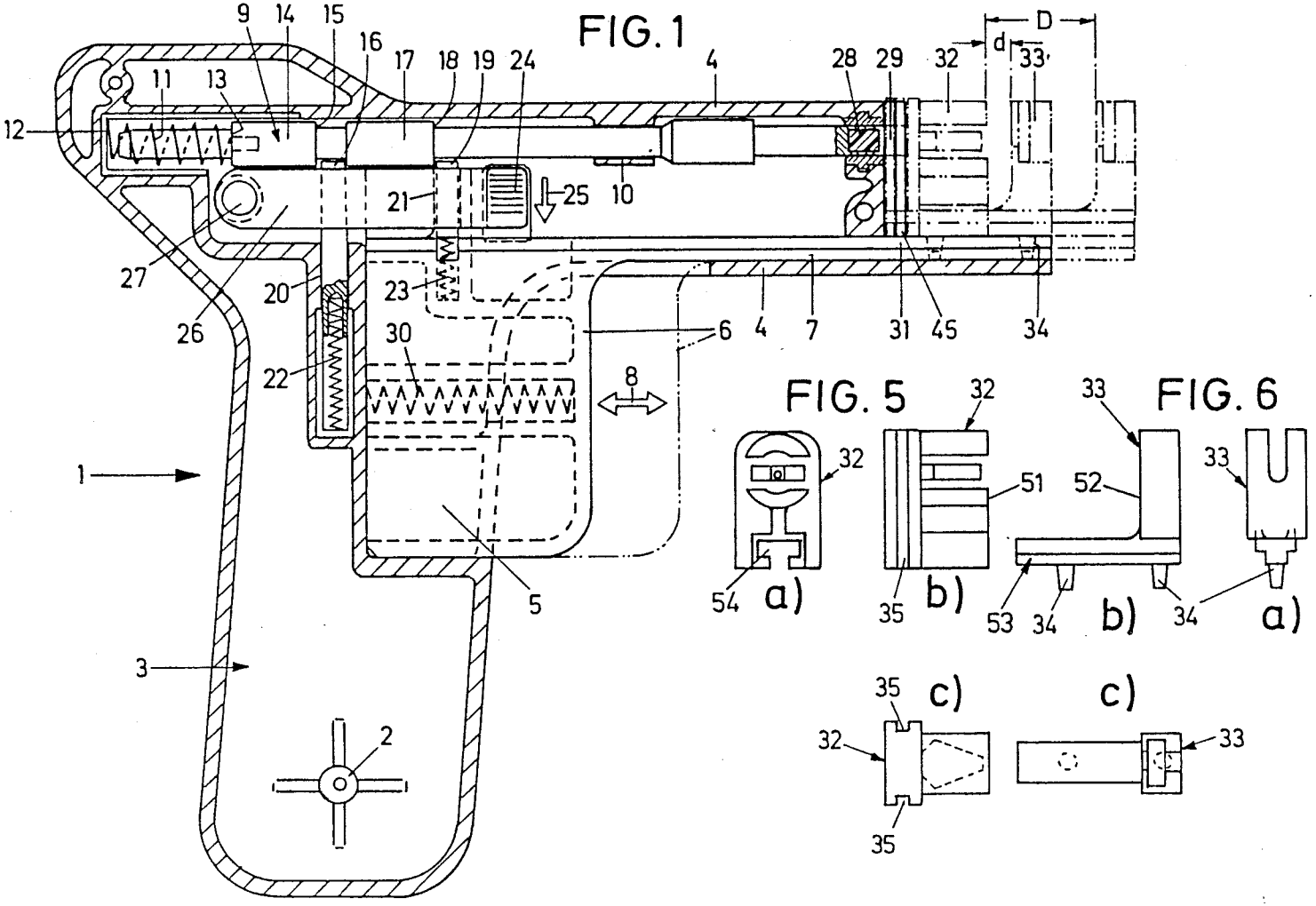
FIG. 1 is a schematic longitudinal section of the device.

The device illustrated in the drawings comprises two housing shells 1 connected with each other by means of a screw 2 which form a grip 3 and a barrel 4. A grip element 6 having a barrel element 7 extending parallel to the barrel 4 is disposed in a recess 5 and is m in the direction cf the arrow 8. The end position, to the right in FIG. 1, has been drawn in by dash-dotted lines.

A firing bolt 9 is guided in the barrel 4 by means of a guide 10. A helical spring 11 at the back end of the bolt 9 rests with one end on an interior surface 12 of the barrel 4 and with the other on an annular shoulder 13 of a first sleeve section 14 of the bolt 9 having a larger diameter than an inner portion of the bolt 9.

Another annular shoulder 15 is formed at the front end of the sleeve section 14 which serves as a stop for a locking bolt 16 which rests on the bolt 9 between the sleeve section 14 and a second sleeve section 17 having an enlarged diameter with respect to the inner portion of the bolt 9. An annular shoulder 18 is formed on the front end of the second sleeve section 17 and is used as a stop for a cocking bolt 19. The locking bolt 16 and the cocking bolt 19 each are guided in recesses 20 or 21, respectively, and are pressed upwardly against the bolt 9 by helical springs 22 or 23, respectively, which are braced against the floor of these recesses 20, and 21.

A trigger 24 is disposed on either side of the barrel 4 in the transition area between the grip 3 and the barrel 4 and can be actuated in a direction vertically with respect to the longitudinal direction of the barrel 4, as indicated by the arrow 25. By means of this trigger, a pivot lever 26 is actuated which is pivotably disposed around a pivot axis 27 and (not shown in detail) presses the locking bolt 16 and the cocking bolt 19, each having an annular shoulder, downwardly by means of a web of the pivot lever 26 acting on these annular shoulders, and in this manner releases the bolt 9. A rubber-like section 28 is provided on the front end of the bolt 9 and emerges through a kind of muzzle 29 in the barrel 4 when triggered. For cocking, the grip element 6 is moved in the direction of the arrow 8 towards the rear of the device against the force of a helical spring 30, which acts on the grip element 6 and which extends parallel to the helical spring 11. The bolt 9 is thus moved along by the cocking bolt 19 and the annular shoulder 18 of the sleeve section 17 until the locking bolt 16 slides off the sleeve section 14 and engages in front of the annular shoulder 15.

A retaining element 32 for a post 36 is mounted in front of the muzzle 29. A groove 35, or a section 50 formed by it, engages an undercut 45 in the area of the muzzle 29 so that the retaining element 32 is also axially fixed.

A retaining element 33 for the locking element 37 is inserted by means of a pin 34 provided on its underside into a rail 31 which can be moved back and forth in the direction of the arrow 8 over the grip element 6.

Figure 3:
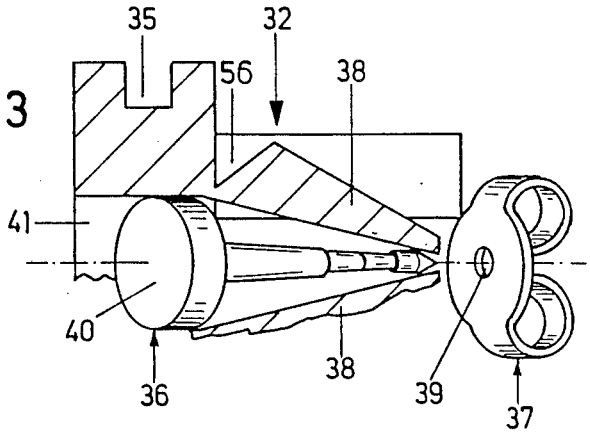
FIG. 3 is a partially sectional, partially perspective view of the association of the locking element with a post located in its retaining element.

FIG. 3 illustrates, in connection with the view in FIG. 1 how a post 36 is maintained in the associated retaining element 32 with respect to a locking element 37.

Figure 2:
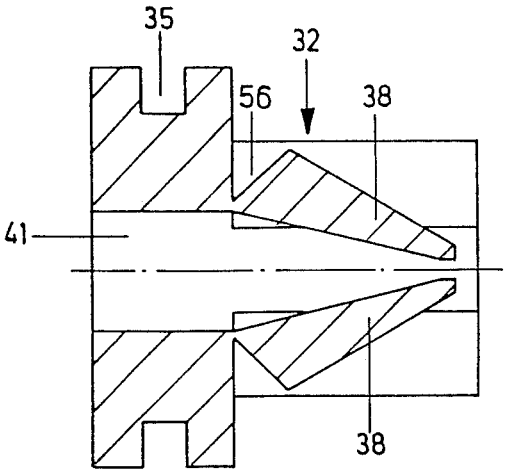
FIG. 2 is a section of the retaining element for the post.

Particularly, in connection with FIG. 2, it becomes clear that the retaining element 32 has resilient legs 38 which on the one hand retain the post in a defined and central position and, on the other, make possible a clean, aimed emergence of the post 36 in the direction of the bore 39 of the locking element 37 when the rubber-like section 28 hits the head 40 as it enters the recess 41 of the retaining element 32.

Figure 4:
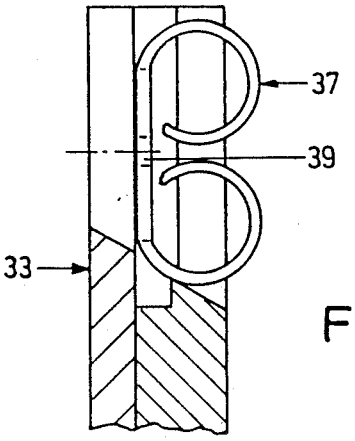
FIG. 4 is a partial side view and partial sectional view of a locking element on the associated retaining element.

FIG. 4 illustrates how the locking element 37 is disposed on its associated retaining element 33.

It becomes clear from the above that the retaining elements 33 and 32, together with the locking element 37 and the post 36 can be disposed in a sterilized package and the locking element and post can be mounted on the device together with the retaining elements without the operator directly touching them at all. The entire process is easily accomplished. The retaining elements are discarded after each use. Only these elements come into contact with the ear lobe when the device is applied.

From the detailed illustrations in FIGS. 5 and 6, in connection with FIG. 1, it becomes particularly clear that the retaining elements 32 and 33 can be fitted together and stored and packed, so that the distance of the front faces 51 and 52 facing the ear lobe of the retaining elements 32 and 33 (distance d) can be kept sufficiently small so that touching of the packaged post parts during insertion of the retaining elements 32, 33 into the device becomes impossible. In this condition the longitudinally extending bottom part 53 of the retaining element 33, which has a swallow-tail cross section, is inserted in a correspondingly swallow-tailed recess 54 of the retaining element 32 for the post 36. This makes problem-free manipulation of the entire device possible. When inserting the retaining elements, the post and the locking element into this device, the grip element 6 is cocked against the force of the spring 30 such that the section 50 can be inserted into the undercut 45 in the area of the muzzle 29 on the one hand and, on the other, the protrusions 34 can be inserted into the corresponding recess in the rail 31. If the grip element 6 is released, the retaining element 32 for the post 36 is maintained in the area of the muzzle 29, but the retaining element 33 for the locking element 37, together with the rail 31 which is connected with the grip element 3, is pushed towards the right in FIG. 1 until a sufficiently large distance D has been attained which makes application of the pistol to an ear lobe possible. The distance D can be very exactly adjusted to the thickness of the respective ear lobe. Because of the transparency of the retaining elements 32 and 33, very exact positioning is still possible. Once the firing position has been set, it no longer can be accidentally changed during firing, because the bolt 9 is fired by a movement of the trigger 24 in the direction of the arrow 25 without jerking and without need of force.

It becomes clear from FIGS. 2 and 3 that after insertion of the post 36, the spring legs 38 of the retaining member 32, which retain the post 36 in the package and during positioning, are bent far back that is, far apart from one another. Because of notch 56, it is ensured that these spring-elastic legs 38 break off during the sudden expulsion movement of the post 36, so that no new post can be inserted into the now no longer sanitary retaining member 32.

It is to be understood that the above description of a preferred embodiment has been given by way of example only and that further variants and improvements are possible within the scope of the invention.

What is claimed is:

1. A device for the injection of posts into ear lobes comprising:

a barrel;

a grip connected to a first end of said barrel;

a bolt disposed in said barrel which is adapted to be cocked against a spring;

a release lever for releasing the spring;

two retaining elements adapted to be releaseably fixed at a second end of said barrel, a first retaining element for receiving a post and a second retaining element for receiving a locking element, said first and second retaining elements being adapted to be positioned at the second end of said barrel such that the post and the locking element are spaced from one another and aligned with one another, said retaining elements having fastening means for the releasable fastening of said first and second retaining elements which support the post and the locking element to said barrel;

wherein the locking element and the post are each adapted to be disposed on said first and second retaining elements and are movable with respect to each other, said first retaining element having a guide recess and said second retaining element having a longitudinally extending bottom part inserted in said guide recess, wherein the surface of the locking element and the post which are to be oriented towards the ear lobe have a sufficiently small outside distance from each other, such that when in a package and when positioned in the device, the surface of the locking element and the post cannot be touched, wherein the second retaining element plugs into the first retaining element when inserted into said barrel, wherein a grip element and a barrel element are placed adjustably with respect to the grip and the barrel, respectively, wherein the mounting device for the retaining element for the locking element is disposed on the barrel element and consists of corresponding projections and recesses, wherein the retaining element for the post has a lateral groove for axial engagement of a corresponding undercut at the barrel such that when the grip element is cocked against the force of said spring the retaining element of the post can be inserted in the groove and the projections of the retaining part of the locking element can be inserted in the recesses with a sufficiently small distance of both retaining elements from each other being maintained, wherein only upon release of the spring tension the retaining elements for the post and the locking element are drawn apart from one another so that the distance between the surface oriented toward the ear lobe is sufficient for an ear lobe to be positioned between them.

2. A device in accordance with claim 1, further comprising a grip element consisting of a first trigger biased by a spring for adjusting the distance between said first retaining element and said second retaining element.

3. A device in accordance with claim 2, wherein said grip element comprises a barrel element connected to said grip element at one end thereof such that said barrel element extends within said barrel, and wherein said grip element and said barrel element are adjustably positioned with respect to said grip and said barrel.

4. A device in accordance with claim 3, further comprising mounting means for mounting said second retaining element on said device disposed on said barrel element.

5. A device in accordance with claim 1, further comprising a lateral groove disposed within said first retaining element adapted to be axially fixed on an undercut on said barrel.

6. A device in accordance with claim 1, wherein said first retaining element comprises resilient retaining legs adapted to rest against the post such that said legs secure the post during storage, transport, and positioning, said legs adapted to be deformed beyond their limits of elasticity and break off when the post is pushed out from within said first retaining element.

7. A device in accordance with claim 1, wherein said first and second retaining elements are made of plastic, in particular of a transparent cellulose acetate.

8. A device in accordance with claim 1, wherein a front end of said bolt is made of a rubber-like material.

9. A device in accordance with claim 1, wherein said bolt comprises a first annular shoulder formed thereon for engaging a spring-loaded cocking bolt connected with said grip.

10. A device in accordance with claim 9, wherein said bolt comprises a second annular shoulder formed thereon closer to the rear end of said barrel than said first annular shoulder for engaging a locking bolt on the grip side with respect to said first annular shoulder.

11. A device in accordance with claim 1, further comprising a second trigger disposed on said barrel which is adapted to be actuated in a direction vertically with respect to the longitudinal direction of said barrel.

12. A device in accordance with claim 1, further comprising a second trigger disposed on a side of said barrel which is adapted to be actuated in a direction vertically with respect to the longitudinal direction of said barrel.

13. A device for the injection of posts into ear lobes comprising:

a barrel;

a grip connected to a first end of said barrel;

a bolt disposed in said barrel which is adapted to be cocked against a spring;

a release lever for releasing the spring;

two retaining elements adapted to be releasably fixed at a second end of said barrel, a first retaining element for receiving a post and a second retaining element for receiving a locking element, said first and second retaining elements being adapted to be positioned at the second end of said barrel such that the post and the locking element are spaced from one another and aligned with one another, said retaining elements having fastening means for the releasable fastening of said first and second retaining elements which support the post and the locking element to said barrel;

wherein the locking element and the post are each adapted to be disposed on said first and second retaining elements and are movable with respect to each other, said first retaining element having a guide recess and said second retaining element having a longitudinally extending bottom part inserted in said guide recess.

wherein the surface of the locking element and the post which are to be oriented towards the ear lobe have a sufficiently small outside distance from each other, such that when in a package and when positioned in the device, the surface of the locking element and the post cannot be touched, wherein a grip element and a barrel element are placed adjustably with respect to the grip and the barrel, respectively, wherein the mounting device for the retaining element for the locking element is disposed on the barrel element and consists of corresponding projections and recesses, wherein the retaining element for the post has a lateral groove for axial engagement of a corresponding undercut at the barrel such that when the grip element is cocked against the force of said spring the retaining element of the post can be inserted in the groove and the projections of the retaining part of the locking element can be inserted in the recesses with a sufficiently small distance of both retaining elements from each other being maintained, wherein only upon release of the spring tension the retaining elements for the post and the locking element are drawn apart from one another so that the distance between the surface oriented toward the ear lobe is sufficient for an ear lobe to be positioned between them, further comprising a second trigger disposed on said barrel which is adapted to be actuated in a direction vertically with respect to the longitudinal direction of said barrel, and a pivot lever adapted to be pivoted by said trigger for moving a locking bolt on said grip and a cocking bolt connected with said grip.

14. A device for the injection of posts into ear lobes comprising:

a barrel;

a grip connected to a first end of said barrel;

a bolt disposed in said barrel which is adapted to be cocked against a spring;

a release lever for releasing the spring;

two retaining elements adapted to be releasably fixed at a second end of said barrel, a first retaining element for receiving a post and a second retaining element for receiving a locking element, said first and second retaining elements being adapted to be positioned at the second end of said barrel such that the post and the locking element are spaced from one another and aligned with one another, said retaining elements having fastening means for the releasable fastening of said first and second retaining elements which support the post and the locking element to said barrel;

wherein the locking element and the post are each adapted to be disposed on said first and second retaining elements and are movable with respect to each other, said first retaining element having a guide recess and said second retaining element having a longitudinally extending bottom part inserted in said guide recess, wherein the surface of the locking element and the post which are to be oriented towards the ear lobe have a sufficiently small outside distance from each other, such that when in a package and when positioned in the device, the surface of the locking element and the post cannot be touched, wherein a grip element and a barrel element are placed adjustably with respect to the grip and the barrel, respectively, wherein the mounting device for the retaining element for the locking element is disposed on the barrel element and consists of corresponding projections and recesses, wherein the retaining element for the post has a lateral groove for axial engagement of a corresponding undercut at the barrel such that when the grip element is cocked against the force of said spring the retaining element of the post can be inserted in the groove and the projections of the retaining part of the locking element can be inserted in the recesses with a sufficiently small distance of both retaining element from each other being maintained, wherein only upon release of the spring tension the retaining elements for the post and the locking element are drawn apart form one another so that the distance between the surface oriented toward the ear lobe is sufficient for an ear lobe to be positioned between them, further comprising a second trigger disposed on a side of said barrel which is adapted to be actuated in a direction vertically with respect to the longitudinal direction of said barrel, and a pivot lever adapted to be pivoted by either of said trigger for moving a locking bolt on said grip and a cocking bolt connected with said grip.

15. A device for the injection of posts into ear lobes comprising:

a barrel;

a grip connected to a first end of said barrel;

a bolt disposed in said barrel which is adapted to be cocked against a spring;

a release lever for releasing the spring;

two retaining elements adapted to be releasably fixed at a second end of said barrel, a first retaining element for receiving a post and a second retaining element for receiving a locking element, said first and second retaining element being adapted to be positioned at the second end of said barrel such that the post and the locking element are spaced from one another and aligned with one another, said retaining elements having fastening means for the releasable fastening of said first and second retaining elements which support the post and the locking element to said barrel;

wherein the locking element and the post are each adapted to be disposed on said first and second retaining elements are movable with respect to each other, said first retaining element having a guide recess and said second retaining element having a longitudinally extending bottom part inserted in said guide recess, wherein the surfaces of the locking element and the post which are to be oriented towards the ear lobe have a sufficiently small outside distance from each other, such that when in a package and when positioned in the device, the surfaces of the locking element and the post cannot be touched, wherein a grip element and a barrel element are placed adjustably with respect to the grip and the barrel, respectively, wherein the mounting device for the retaining element for the locking element is disposed on the barrel element and consists of corresponding projections and recesses, wherein the retaining element for the post has a lateral groove for axial engagement of a corresponding undercut at the barrel such that when the grip element is cocked against the force of said spring the retaining element of the post can be inserted in the groove and the projections of the retaining part of the locking element can be inserted in the recesses with a sufficiently small distance of both retaining elements from each other being maintained, wherein only upon release of the spring tension the retaining elements for the post and the locking element are drawn apart from one another so that the distance between the surfaces oriented towards the ear lobe is sufficient for an ear lobe to be positioned between them, wherein a second trigger is disposed on said barrel which is adapted to be actuated in a direction vertically with respect to the longitudinal direction of said barrel, and wherein a pivot lever is adapted to be pivoted by a first trigger for moving a locking bolt and a cocking bolt.

16. A device in accordance with claim 15, wherein said trigger is disposed on a side of said barrel.

* * * * *